United States Patent [19]

Underwood

[11] 4,091,844

[45] May 30, 1978

[54] LOOM HARNESS

[75] Inventor: James L. Underwood, Woodstock, Ga.

[73] Assignee: Pioneer Heddle and Reed Company Incorporated, Atlanta, Ga.

[21] Appl. No.: 771,938

[22] Filed: Feb. 25, 1977

[51] Int. Cl.[2] ..... D03C 9/06

[52] U.S. Cl. ..... 139/91

[58] Field of Search ..... 139/91, 92, 82, 84, 139/88

[56] References Cited

U.S. PATENT DOCUMENTS

| | | | |
|---|---|---|---|
| 3,417,787 | 12/1968 | Kaufmann | 139/91 |
| 3,424,205 | 1/1969 | Koch | 139/91 |
| 3,470,920 | 10/1969 | Kaufmann et al. | 139/91 |
| 3,970,114 | 7/1976 | Baumann | 139/91 |

FOREIGN PATENT DOCUMENTS

| | | | |
|---|---|---|---|
| 430,615 | 8/1967 | Switzerland | 139/91 |

*Primary Examiner*—Henry S. Jaudon

*Attorney, Agent, or Firm*—Newton, Hopkins & Ormsby

[57] ABSTRACT

A loom harness in which the rails thereof are provided with protective attachments here illustrated as nose guides, each of which is formed from a pair of opposed, interlocking molded abrasive resistant plastic elements. The elements are identical to each other and have at one end locking flanges which when fitted together, form a twist-lock assembly for removably joining the ends of the pair of elements together. At the other ends of the elements, there are provided two rows of inwardly extending, staggered opposed blocks within the elements, the blocks intermeshing when the elements are in registry and having grooves or slots which align for slideably receiving the edges of a flat removable tongue for joining the elements together. The plastic of the respective elements may be the same or different so as to provide the same or different wear characteristics. By such a construction, the nose guide is readily removable without the necessity of removing the frame from the weaving loom. Also shown is the protective attachment as a support for the heddle rod support.

20 Claims, 7 Drawing Figures

LOOM HARNESS

BACKGROUND OF THE INVENTION

1. Field of the Invention

This invention relates to a loom harness and is more particularly concerned with protective attachments for the top and bottom rails of the harness frame of a weaving loom, these attachments serving as nose guides to protect the rails and also to serve as supports for the heddle supporting rods.

2. Description of the Prior Art

In the past, protective attachments in the form of nose guides or supports for heddle supporting rods, which removably surround the rails of a heddle frame, have been suggested. U.S. Pat. No. 3,901,282 discloses such a prior art device. In this prior art device, integral snap fasteners are provided which can be parted by a screwdriver or other wedge-like instrument so that the nose guide can be removed from the frame while the frame is in the loom or in the drawing-in machine. Some difficulty is encountered, however, in removing and replacing these prior art nose guides since the snap fasteners require the nose guide to be spread apart to an extent sufficient that the fastener elements will clear the rail.

In addition, the use of four widely spaced snap fasteners may not provide sufficient strength to preclude vertical lateral bending of the nose guide when in use. Such bending and the vibrations are imparted to the rails and to the nose guides tend to unsnap the snap fasteners, during operation, thereby causing the nose guide to become loosened upon the rail.

It has also been proposed in Swiss Pat. No. 430,615 issued to E. Frohlich A. G. to construct nose guides of two pieces of solid cross-section held together by screws. The two parts are not interchangeable and the screws may be loosened with vibration.

The applicant is also aware of the prior art patents cited in U.S. Pat. No. 3,901,282.

It is the object of the present invention to provide a protective attachment for the top and bottom rails of heddle frames of weaving looms, the attachment being readily and easily installed and removed from the rails while the frames are installed in the weaving looms or on the drawing-in machine.

Another object of the present invention is to provide an attachment for the top and bottom rails of a heddle frame, the attachment being capable of being installed on the rails and removed therefrom with a minimum of working space.

SUMMARY OF THE INVENTION

Briefly described, the present invention comprises a protective attachment in the form of a nose guide or a device which is capable of supporting the heddle supporting rods, the attachment being in surrounding relationship on the rail of the heddle frame. This attachment, which is illustrated primarily as a nose guide, includes a pair of opposed identical elements which are capable of surrounding the rail. The elements at there lower ends, are provided with flanges capable of being interlocked to form a twist-lock assembly joining the bottom portions of the elements together. The upper portion of the elements, above the rail, are joined together by a slideable tongue which is received in juxtaposed rows of blocks projecting from the inner surfaces of the elements so as to cooperate with the blocks of the opposing element in forming inwardly opening channels receiving the opposite edge portions of a flat rectangular tongue. The tongue can be readily installed or removed from the end of the attachment.

DESCRIPTION OF THE PREFERRED EMBODIMENT

Figure 1:
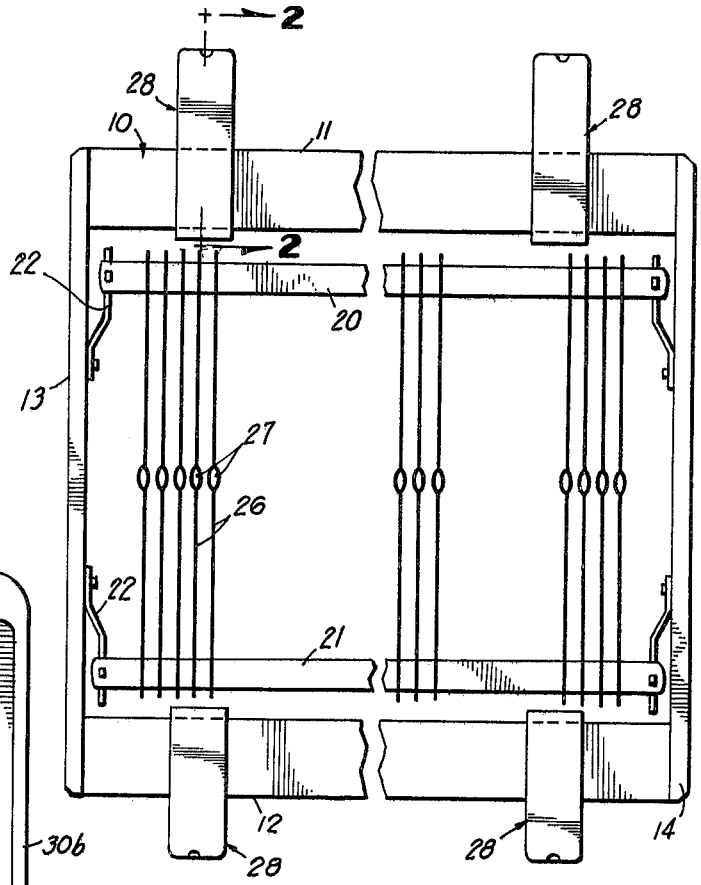
FIG. 1 is a front elevational view of a heddle frame having protective attachments in the form of nose guides installed thereon, the nose guides being constructed in accordance with the present invention.
Figures 6, 7:
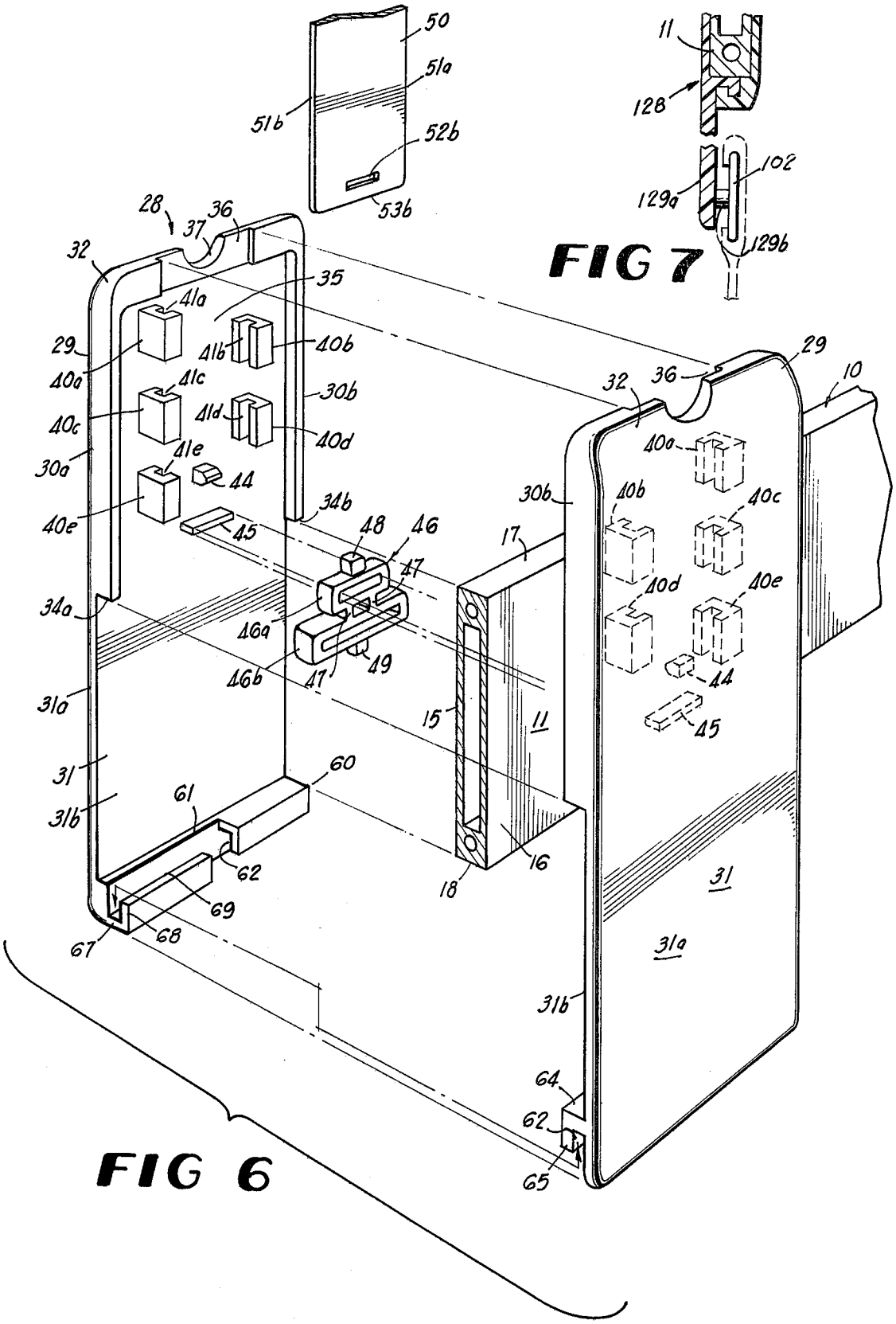
FIG. 6 is an exploded perspective view of the nose guide of the present invention encompassing the rail of the heddle frame.
FIG. 7 is a fragmentary side elevational view of a second embodiment of the present invention in which the attachment is in the form of a support for the heddle support rod of a heddle frame.

Referring now in detail to the embodiments chosen for the purpose of illustrating the present invention Numeral 10, in FIG. 1, denotes generally a conventional rectangular heddle frame comprising top and bottom horizontally disposed identical rails 11, 12 and vertical side members 13, 14 which interconnect the ends of rails 11 and 12 to maintain the rails 11, 12 in spaced parallel relationship. As can be seen in FIG. 6, the rail 11 is preferably made of thin, rectangularly shaped aluminum extrusion tubing having opposed vertical walls 15, 16 joined by horizontally disposed top and bottom walls 17, 18. Rail 12 is identical to rail 11, in cross-section.

The heddle frame 10 further includes upper and lower heddle supporting rods 20, 21 which are held in place by means of spring clips 22 mounted on vertical side members 13, 14. Portions of the spring clips 22 are removably received in aperture in the end portions of rods 20 and 21. The heddle supporting rods 20 slideably support, therebetween, a plurality of heddles 26 having central warp eyes 27 for controlling the shed. The structure thus far described in conventional According to the present invention, attachments, here depicted as nose guides 28, are mounted in spaced relationship upon the rails 11, 12 and function to space the frame 10 from adjacent frames. Nose guides 28 are made of any suitable material, preferably a synthetic plastic material having a low coefficient of friction when in rubbing contact with other similar nose guides. Suitable material include the plastic available under the trade name DELRIN, as well as NYLON is suitable formulations.

Figure 2:
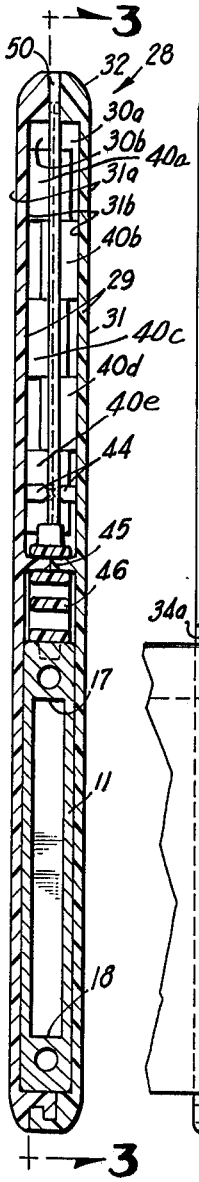
FIG. 2 is an enlarged vertical sectional view taken substantially along line 2—2 in FIG. 1.

As best seen in FIGS. 2 and 6, each nose guide 28 is comprised of two opposed, mateably or registrable attachment elements 29. FIGS. 2 through 6 illustrate an attachment or nose guide 28 which can be mounted on either the top rail 11 or the bottom rail 12, but for ease of structural disclosure, is shown as mounted on top rail 11. When the nose guide 28 is on the bottom rail 12, it is inverted from the positions shown in FIGS. 2 through 6.

Each element 29 is a channel-shaped member longer than the vertical width of rail 11 and having a thin, flat, rectangular central panel or wall 31 with flat parallel outer and inner surfaces 31*a* and 31*b*. The upper or outer end portion of panel 31 carries an inwardly extending, generally rectangular outer end 32 which has a curved convex outer surface. The side edges of end wall 32 are rounded and respectively merge with the upper ends of a pair of rectangular spaced, opposed, parallel side walls 30*a* and 30*b*. The lower or inner ends 34*a* and 34*b* of the side walls 30*a* and 30*b* terminate approximately midway of panel 31.

It is now seen that the side walls 30*a*, 30*b* and end wall 32 terminate in inner surfaces disposed in a common plane parallel to and spaced from the panel 31. These walls 30*a*, 30*b* and 32 form an inverted U-shaped rim which partially encircles a central tongue receiving cavity 35. The central portion of the end wall 32 is recessed or notched to define an inwardly opening channel or groove 36 which cooperates with a similar channel of an opposed registering element 29 to form a closed tongue receiving aperture. A concaved upperwardly opening recess 37 centrally in the top end 32 forms a finger access opening.

Inwardly of the tongue receiving groove 36, the cavity 35 is provided with a plurality of staggered right prism or rectangular tongue receiving blocks 40*a*, 40*b*, 40*c*, 40*d* and 40*e*, disposed in opposed, parallel, vertical rows, each block being integrally joined by its inner end to the inner surface 31*b* of the panel 31. Blocks 40*a*, 40*c* and 40*e*, which are inwardly adjacent to wall 30*a*, have inwardly opening recesses or apertures 41*a*, 40*c*, and 41*e* which are in vertical alignment with each other along one side portion of the cavity 35. Blocks 40*b* and 40*d* which are inwardly adjacent to wall 30*b* have inwardly opening recesser or apertures 41*b* and 41*d* in vertical alignment with each other along the other side of cavity 35.

Blocks 40*a*, 40*c* and 40*e* are respectively vertically spaced from each other by a distance approximately equal to the respective widths of blocks 40*b* and 40*d*. Also, the blocks 40*b* and 40*d* are spaced apart by a distance approximately equal to the width of the central block 40*c*. Therefore, due to the staggering of the blocks, when one element 29 is brought into registry with an opposed element 29, block 40*c* of one element 29 will fit between blocks 40*b* and 40*d* of the other element 29; block 40*b* will fit between blocks 40*a* and 40*c* of the other element 29; and block 40*d* of one element will fit between blocks 40*c* and 40*e*, of the other, as shown by broken lines in FIG. 3.

The plane of the inner surfaces of walls 30*a*, 30*b* and 32 coincides with the central portion of the recesses 41*a*, 41*b*, 41*c*, 41*d*, 41*e* of all blocks 40*a*, 40*b*, 40*c*, 40*d* and 40*e* so that when elements 29 are in registry, the opposed tongue receiving channels 36 define a closed rectangular tongue receiving aperture in the upper end of the nose guide 28 and this aperture is vertically aligned with the recesses 41*a*, 41*b*, 41*c*, 41*d* and 41*e* of the interdigitated blocks 40*a*, 40*b*, 40*c*, 40*d* and 40*e*.

Figure 3:
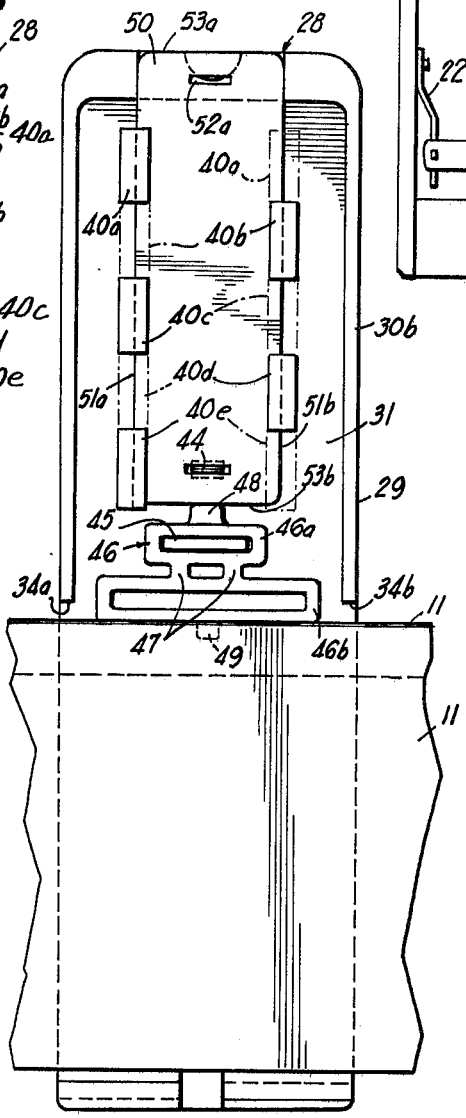
FIG. 3 is a vertical sectional view taken substantially along line 3—3 and FIG. 2.
Figure 4:
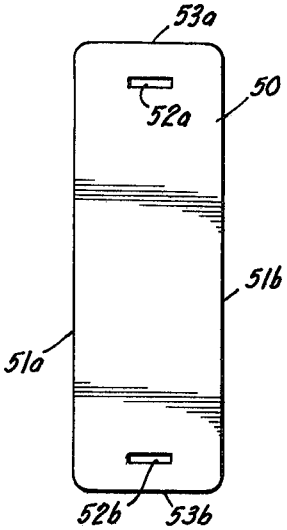
FIG. 4 is a front elevational view of the tongue of the nose guide depicted in FIGS. 1, 2 and 3.
Figure 5:
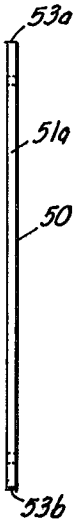
FIG. 5 is a side elevational view of the tongue depicted in FIG. 4.

A flat rectangular detent tongue or locking plate 50, best seen in FIGS. 4 and 5, is for the purpose of locking the two elements 28 in registry, as shown in FIGS. 2, 3. The width of the tongue 50 is therefore, approximately equal to or slightly less than the transverse distance between the inner portions of opposed recesses 41*a*, 41*b*, 41*c*, 41*d*, and 41*e* of blocks 41*a*, 40*b*, 40*c*, 40*d*, 40*e* and greater than the minimum transverse distance between opposed blocks 40*a*, 40*b*, 40*c*, 40*d* and 40*e*. Thus, when the elements 29 are in registry and the tongue 50 is inserted into the nose guide 28, as depicted in FIG. 3, the opposite parallel side edges 41*a* and 51*b* of tongue 50 are received in the aligned recesses 41*a*, 41*b*, 41*c*, 41*d*, 41*e* of the interdigitated blocks 40*a*, 40*b*, 40*c*, 40*d* 40*e* of both elements 29 so as to lock upper or outer ends of the elements 29, together. Concaved central finger recesses 37 in walls 32 of elements 29 facilitates removal of the tongue 50.

The tongue 50 has rectangular, detent receiving holes 52*a* and 52*b* in the opposed central end portions of the tongue 50 to selectively receive the opposed end portions of inwardly protruding yieldable finger detents 44. Each finger detent 44 is a flat rectangular member secured by its inner end to the inner surface 31*b* between and preferably below the blocks 41*d* and 40*e*. The inner end of detent 44 is tapered and terminates about in the plane of the inner surfaces of walls 30*a*, 30*b* and 32. Thus, when the tongue 50 is inserted (either end 53*a* or end 53*b*, first) into the registering elements 29, to its full extent, the outer ends of detents 44 will project into the hole 52*a* or 52*b*, as the case may be.

Inwardly, i.e., below the detent 44, each element 29 has a central spring supporting plate 45 which is a flat rectangular member which protrudes inwardly from the inner surface 31*b* of panel 31 to abut a similar inwardly protruding plate 45 of a registering element 29. The function of the plates 45 is to support a yieldable plastic spring member 46.

Spring member 46 includes an upper, open, rectangular, transverse frame 46*a* and a lower, larger, open, rectangular, transverse frame 46*b* spaced inwardly of and parallel to frame 46*a*. Spaced vertical bars 47 join the inner opposed sides of frames 46*a* and 46*b*. The outer sides of frames 46*a* and 46*b* have central oppositely protruding fingers 48 and 49, respectively. The upstanding or outwardly protruding finger 48 forms a spring abutment member against which the inner edge 53*a* or 53*b* of tongue 50 rests when the tongue 40 is fully inserted into the registering elements 29. The downward or inwardly protruding finger 49 is adapted to be received in an appropriate hole 49*a* in wall 17 as the lower or inner surface of frame 49*b* rests upon the outer or upper surface of wall 17, as seen in FIG. 3.

The spring member 46 serves three functions. Firstly, it forms a yieldable abutment for tongue 50. Secondly, it yieldably urges the elements outwardly of the rail 11 so as to cause the nose guide 28 to be urged snugly against the bottom or inner portion of rail 10. Thirdly, the finger 49 prevents movement of the nose guide 28 along the length of rail 10.

At the lower or inner end portions of the panel 31 of the element 29 is one twist-lock locking element of a twist-lock assembly, the function of which is to cooperate with an identical twist-lock locking element of an opposing element 29 for securing the botton or inner portions of the two elements 29 together as shown in FIGS. 2, 3 and 6. In more detail, each twist-lock locking element includes a bottom inwardly protruding rectangular shoulder 60 which extends transversely, from side-to-side, across the inner botton surface of the panel 31. The shoulder 60 has an upper, straight, transverse ledge surface 61 which is perpendicular to the inner surface 31*b*, being joined thereto along a common straight edge 62.

An L-shaped, downwardly opening, first latch member extends inwardly from a side portion of shoulder 60, the latch member being to one side of a vertical certerline and including a top flange 54 which protrudes horizontally inwardly and a downwardly protruding vertical latching flange 65 joined along a common edge 66, the flange 65 being parallel to surface 31*b* and spaced outwardly from the shoulder 60.

The other half of the locking element includes an L-shaped upwardly opening second latch member to the other side of the centerline, the second latch member extending inwardly from the other side portion of shoulder 60 and spaced from the downwardly opening first latch member. The upwardly opening second latch member includes a bottom flange 67 which protrudes inwardly from shoulder 60 and an upwardly extending vertical flange 68 joined to flange 67 along common edge 69.

Flanges 65 and 68 are spaced aligned flanges which, when opposed elements 29 are brought together in angular related positions and then pivoted to upright registry, the flange 65 of one element 29 will be received in the upwardly opening groove between flange 68 and shoulder 60 while flange 68 will be receiving in the downwardly opening groove between shoulder 60 and flange 65 of the other element 29.

The two elements 29 are assembled together by first assembling the twist-lock assembly, as described above. Then, the spring member 46 is inserted on the rail 11 and, thereafter, the top or outer portions of the registering elements 29 are urged apart, so that the nose guide can be fitted around the rail 11 and over the spring member 46, one plate 45 protruding into the upper smaller frame 46*a*. Next, the top or outer portions of elements 29 are brought together and the tongue 50 inserted.

When assembled around the rail 11, the surface or ledge 61 of both elements 29 are urged flat against the bottom wall 18, the surfaces 31*b* are flat against walls 16 and 17 respectively.

In FIG. 7 the protective attachment 128 is shown in the form of a support for a heddle support rod having elements 129*a* and 129*b*. The element 129*b* extends below or inwardly of rail 11, being provided with a strap 101 which supports the heddle supporting rod 102. Otherwise, the device of FIG. 7 is identical to the nose guide 28.

I claim:

1. An element of a protective attachment which cooperates with a similar element thereof to form said protective attachment for surrounding the rail of a heddle frame comprising:

(a) a panel of a vertical length greater than the width of said rail;

(b) means for securing one end portion of said panel to a similar end portion of an opposed similar panel of a similar element; and (c) detent means for releasably securing the other end portion of said panel to the other end portion of said similar panel, said detent means including a transversely extending block protruding from the inner surface of said panel toward said similar panel, said block being provided with an opening therein which is for alignment with a similar opening, of a similar block on said similar element when the two elements surround said rail.

2. The element defined in claim 1 wherein said opening is disposed along a vertical axis.

3. The element defined in claim 1 including inwardly extending walls protruding from the inner surface edge portion of said other end portion of said panel and partially encompassing said block, said walls terminating in a common plane parallel to the inner surface of said panel, the opening of said block being in said common plane, one of said walls having an opening aligned with said opening of said block so that a locking member can be removably inserted through the openings for securing said other end of said panel and said other end of said similar panel together.

4. The element defined in claim 3 including additional blocks extending from said inner surface, said additional blocks being spaced from each other, said additional blocks having openings aligned with the opening of the first mentioned block.

5. The element defined in claim 4 wherein said blocks form a pair of spaced vertical rows and the openings of said blocks open toward each other for receiving opposite parallel edge portions of said locking member.

6. The element defined in claim 5 wherein said blocks in one row are staggered with respect to the blocks of the other row.

7. A protective attachment for surrounding the rail of a loom harness comprising a pair of opposed registering attachment elements for being positioned on opposite sides of said rail, said elements being longer than the width of said rail so as to protrude beyond the edges of said rail in both directions, a locking means for joining the ends of said elements adjacent to one edge of said rail and detent means for joining the other ends of said elements adjacent to the other edge of said rail, said detent means including overlapping blocks protruding inwardly from said elements, said overlapping blocks having openings which are aligned when the blocks are overlapping, and a locking member inserted through said openings.

8. The protective attachment defined in claim 7 wherein said blocks are arranged in parallel rows and said openings of the blocks of the respective rows open toward each other and are in a common plane and wherein said locking member is a flat tongue received by its edges in said openings.

9. The protective attachment defined in claim 8 wherein said elements have panels in parallel planes, and the plane of said openings is disposed midway between and parallel to the planes of said panels.

10. The protective attachment defined in claim 8 wherein said elements are provided with a tongue receiving opening and said tongue extends through said opening, an outer portion of said tongue being outwardly of said elements so as to be grasped between the fingers of a person for withdrawal of the tongue.

11. The protective attachment defined in claim 7 including a spring member carried between said elements, said spring member being adapted to ride upon the edge of said rail and urge the elements into engagement with said rail.

12. The protective attachment defined in claim 11 wherein a finger protrudes from said spring member for being received in a hole in the edge of said rail.

13. The protective attachment defined in claim 11 including a finger extending from said spring member for being engaged by the end of said locking element.

14. The protective attachment defined in claim 7 wherein said means includes a twist-lock assembly in which each element has oppositely extending flanges which overlap similar flanges of the other element when they are locked, the assembly abutting one edge of said rail when said elements are installed on said rail.

15. A loom harness of the type having a rail of rectangular cross section and a protective attachment of the type having a pair of opposed elements on opposite sides of the rail and removably secured together about said rail by detent means, the improvement comprising wherein said detent means includes a slideable tongue slideably received between said elements and wherein said elements have alignable openings in the respective elements which are aligned only when the elements are in abutting registry, said openings receiving said tongue to prevent appreciable movement of said elements out of abutting registry.

16. The loom harness defined in claim 15 wherein said openings are aligned in parallel rows and receive the opposite edges of said tongue.

17. The loom harness defined in claim 15 wherein said tongue is provided with a central opening at one end portion thereof, and wherein one of said elements is provided with an inwardly protruding finger which projects into said opening when said tongue is fully inserted between elements.

18. The loom harness defined in claim 15 including a spring member carried between said elements, said spring member riding against one edge of said rail for urging the elements against the opposite edge of said rail.

19. The loom harness defined in claim 18 wherein said spring member includes a finger projecting from said spring member and received within a hole of said rail.

20. The loom harness defined in claim 18 wherein said spring member includes a finger projecting toward said tongue for abutting the end of said tongue.

* * * * *